US010317820B1

(12) United States Patent
Hayashi

(10) Patent No.: US 10,317,820 B1
(45) Date of Patent: Jun. 11, 2019

(54) TONER SUPPLY DEVICE AND IMAGE FORMING APPARATUS

(71) Applicant: Konica Minolta, Inc., Chiyoda-ku, Tokyo (JP)

(72) Inventor: Hideji Hayashi, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/160,774

(22) Filed: Oct. 15, 2018

(30) Foreign Application Priority Data

Dec. 4, 2017 (JP) ..... 2017-232706

(51) Int. Cl.
*G03G 15/10* (2006.01)
*G03G 15/00* (2006.01)

(52) U.S. Cl.
CPC ..... *G03G 15/104* (2013.01); *G03G 15/556* (2013.01); *G03G 2215/066* (2013.01)

(58) Field of Classification Search
CPC ..... G03G 15/104; G03G 15/556; G03G 2215/066
See application file for complete search history.

(56) References Cited

U.S. PATENT DOCUMENTS

2003/0133722 A1* 7/2003 Kaiho ..... G03G 15/0856 399/27
2007/0003296 A1* 1/2007 Miyata ..... G03G 15/553 399/27

FOREIGN PATENT DOCUMENTS

JP 2002-341636 11/2002
JP 2008-033197 2/2008
JP 4474678 6/2010

* cited by examiner

*Primary Examiner* — Sandra Brase
(74) *Attorney, Agent, or Firm* — Squire Patton Boggs (US) LLP

(57) ABSTRACT

A toner supply device includes a toner container, a detector, and a determiner. The toner container is configured to contain toner to be supplied to a developing device. The toner container is capable of discharging a prescribed amount of toner contained therein. The detector is configured to detect an amount of toner to be supplied to the developing device. The determiner is configured to estimate a timing at which toner remaining in the toner container is completely consumed, based on a driving amount applied for discharging toner from the toner container during a time period from when the prescribed amount of toner is discharged from the toner container until when the detector detects an amount of toner equal to the prescribed amount of toner.

18 Claims, 7 Drawing Sheets

TONER SUPPLY DEVICE AND IMAGE FORMING APPARATUS

The entire disclosure of Japanese Patent Application No. 2017-232706, filed on Dec. 4, 2017, is incorporated herein by reference in its entirety.

BACKGROUND

Technological Field

The present invention relates to a toner supply device and an image forming apparatus.

Description of the Related Art

The technique for calculating the amount of toner remaining in a toner container is disclosed in Japanese Laid-Open Patent Publication No. 2002-341636. Japanese Laid-Open Patent Publication No. 2008-33197, and Japanese Patent No. 4474678.

SUMMARY

The toner consumption amount is predicted from the coefficient of loner conveyance amount and the rotation time of a conveyance screw located downstream from a toner container, to calculate the amount of toner remaining in the toner container. In this case, variations occur between the actual toner consumption amount and the predicted toner consumption amount due to the use environment of the image forming apparatus, the use conditions of the image forming apparatus, the storage conditions of the toner container, the production conditions of toner the component accuracy, and the like. As a result, the actual remaining toner amount cannot be accurately obtained, so that the accuracy of estimating the toner near empty state deteriorates.

The present disclosure provides a toner supply device and an image forming apparatus, for which the accuracy of estimating the amount of toner remaining in a toner container can be improved.

To achieve at least one of the above-mentioned objects, according to an aspect of the present invention, a toner supply device reflecting one aspect of the present invention comprises a toner container, a detector, and a determiner. The toner container is configured to contain toner to be supplied to a developing device. The toner container is capable of discharging a prescribed amount of toner contained therein. The detector is configured to detect an amount of toner to be supplied to the developing device. The determiner is configured to estimate a timing at which toner remaining in the toner container is completely consumed, based on a driving amount applied for discharging toner from the toner container during a time period from when the prescribed amount of toner is discharged from the toner container until when the detector detects an amount of toner equal to the prescribed amount of toner.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
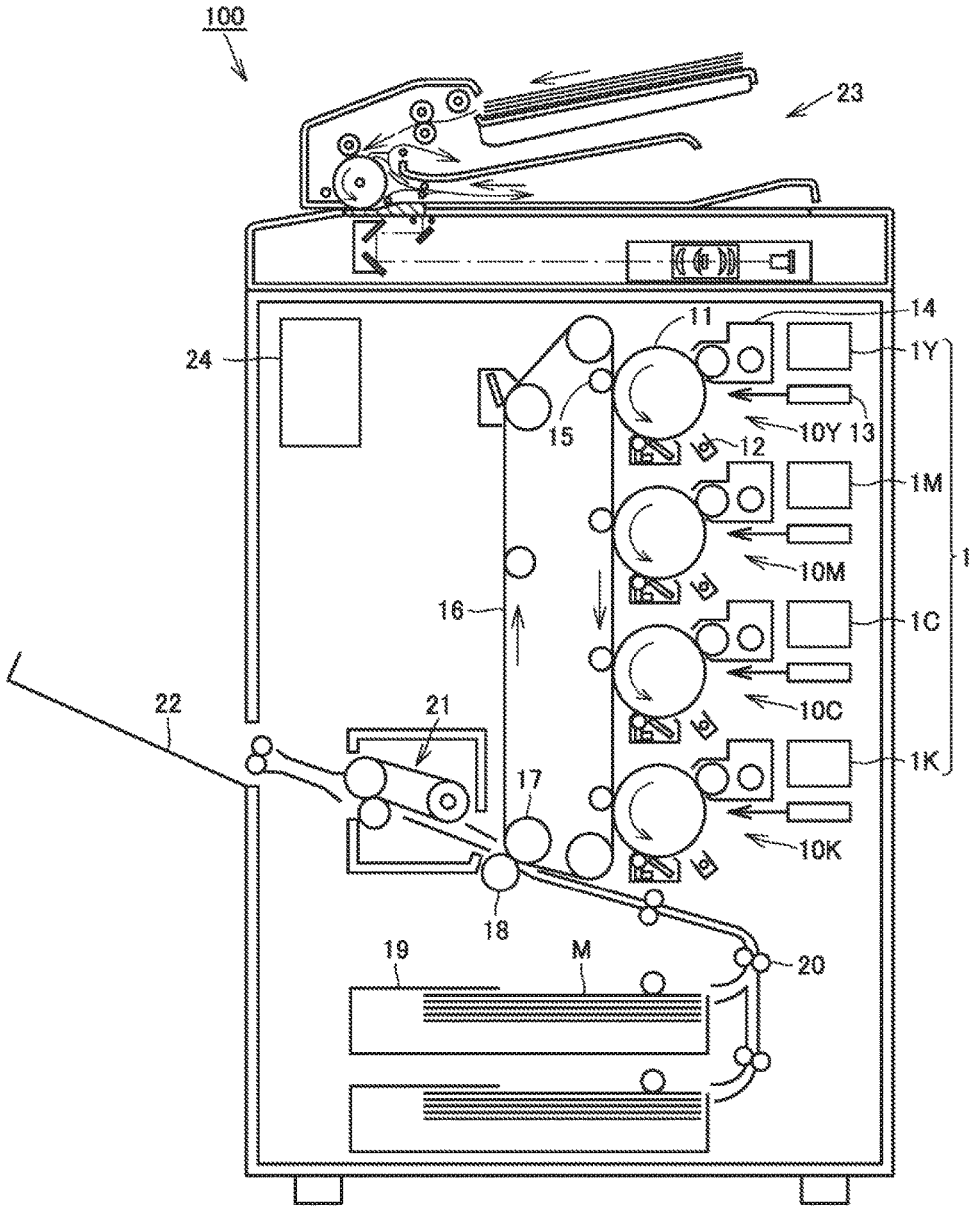
FIG. 1 is a schematic diagram showing an image forming apparatus in the first embodiment.

Hereinafter, one or more embodiments of the present invention will be described with reference to the drawings. However, the scope of the invention is not limited to the disclosed embodiments.

In the following, a toner supply device and an image forming apparatus in each of embodiments will be described with reference to the accompanying drawings. In the embodiments described below, the same or substantially the same configurations are designated by the same reference characters, and description thereof will not be repeated. The configurations in the embodiments described below may be selectively combined as appropriate.

First Embodiment (Image Forming Apparatus 100)

FIG. 1 is a schematic diagram showing an image forming apparatus 100 in the first embodiment. Image forming apparatus 100 includes: image forming units 10Y, 10M, 10C, and 10K; toner supply devices 1Y, 1M, 1C, and 1K; an intermediate transfer belt 16; a support roller 17; a secondary transfer roller 18; a cassette 19; a conveying roller 20; a fixing device 21; a medium discharge unit 22; and an image reading unit 23.

Toner supply device 1 includes toner supply devices 1Y, 1M, 1C, and 1K corresponding to their respective colors. Image forming unit 10 includes image forming units 10Y, 10M, 10C, and 10K corresponding to their respective colors. Each of image forming units 10Y, 10M, 10C, and 10K includes a photoreceptor 11, a charging device 12, an exposure device 13, a developing device 14, and a primary transfer roller 15.

Photoreceptor 11 has a surface that is uniformly charged by charging device 12. Exposure device 13 is controlled by a controller (not shown) to expose the surface of photoreceptor 11 based on the image information from image reading unit 23 or the image information received from outside. An electrostatic latent image is formed on the surface of photoreceptor 11. When developing device 14 develops the electrostatic latent image, a toner image corresponding to the image information is formed on the surface of photoreceptor 11 (developing process).

When the toner in developing device 14 is reduced, developing device 14 requests toner supply device 1 corresponding to each of developing devices 14 to resupply toner. In accordance with the amount of toner consumed in developing device 14, toner supply device 1 resupplies toner to developing device 14.

The toner image formed on the surface of photoreceptor 11 is transferred by the electric field applied from primary transfer roller 15 onto intermediate transfer belt 16 in the primary transfer section between photoreceptor 11 and primary transfer roller 15 (primary transfer process). Intermediate transfer belt 16 is tensioned by a plurality of support rollers 17, and moved with the received driving force. The toner images formed by image forming units 10Y, 10M, 10C, and 10K are superimposed on one another on intermediate transfer belt 16. A secondary transfer section is provided between support roller 17 (intermediate transfer belt 16) and secondary transfer roller 18.

Conveying roller 20 forms a recording-medium conveyance path. A recording medium M housed in cassette 19 is fed through this recording-medium conveyance path to the secondary transfer section. By the electric field applied from secondary transfer roller 18, the toner image on intermediate transfer belt 16 is transferred onto recording medium M in the secondary transfer section (secondary transfer process). The toner image on recording medium M is heated and pressurized by fixing device 21 and fixed onto recording medium M (fixing process). Then, recording medium M is discharged to medium discharge unit 22.

Image forming apparatus 100 further includes a controller 24. Controller 24 is configured to control image forming unit 10, fixing device 21 and the like in the processes from the developing process to the fixing process as described above.

(Toner Supply Device 1)

Figure 2:
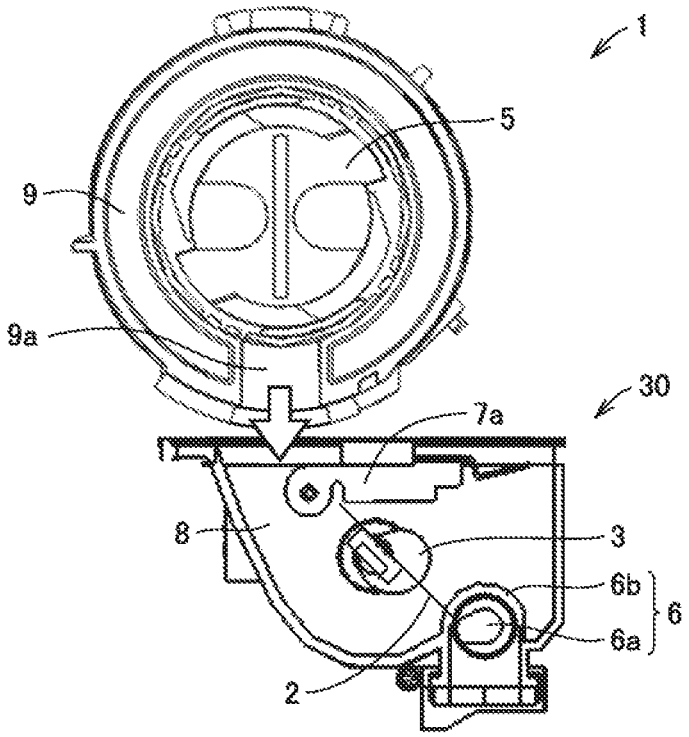
FIG. 2 is a schematic cross-sectional view of a toner supply device in the first embodiment.
Figure 3:
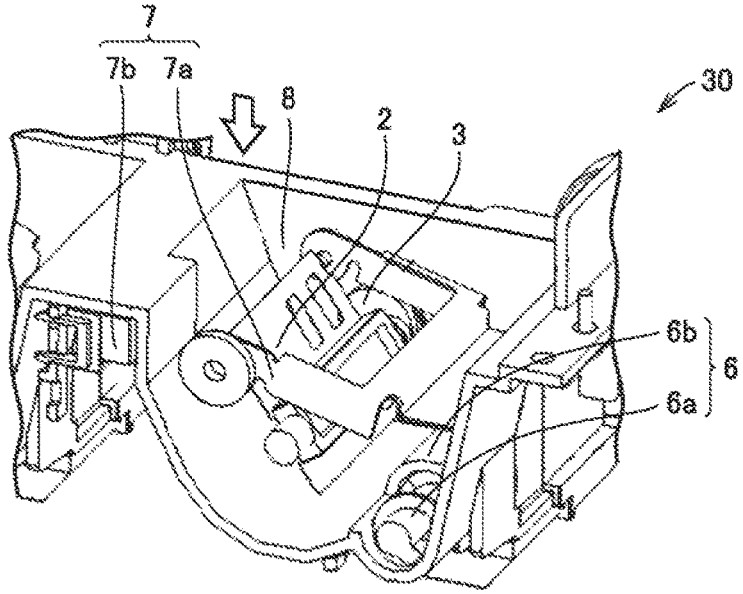
FIG. 3 is an enlarged perspective view of a sub hopper unit shown in FIG. 2.

FIG. 2 is a schematic cross-sectional view showing toner supply device 1 in the first embodiment. FIG. 3 is an enlarged perspective view of a sub hopper unit 30 shown in FIG. 2. Referring to FIGS. 2 and 3, toner supply device 1 will be hereinafter described. Toner supply device 1 includes a container accommodating unit 9, a toner container 5, and sub hopper unit 30.

Container accommodating unit 9 accommodates toner container 5. Container accommodating unit 9 has a discharge portion 9*a*. The toner contained in toner container 5 is discharged through discharge portion 9*a*. Toner container 5 is installed in container accommodating unit 9. Toner container 5 is attachable to and detachable from container accommodating unit 9.

When toner container 5 is installed in container accommodating unit 9, the toner sealing member (not shown) is moved in accordance with the installation operation. As the toner sealing member is moved, discharge portion 9*a* is opened. Thereby, the toner contained in toner container 5 is discharged through discharge portion 9*a* to sub hopper unit 30 (as indicated by outlined arrows in FIGS. 2 and 3).

(Sub Hopper Unit 30)

Sub hopper unit 30 is provided downstream from toner container 5. Sub hopper unit 30 is provided between toner container 5 and developing device 14. The toner discharged from toner container 5 to sub hopper unit 30 is stored in sub hopper unit 30. The toner stored in sub hopper unit 30 is supplied to developing device 14 in response to the request from developing device 14. Sub hopper unit 30 includes a toner storage unit 8, a stirring unit 2, a cam unit 3, a detector 7, and a supply unit 6.

Toner storage unit 8 stores the toner discharged from toner container 5. The maximum loadable volume of toner storage unit 8 is determined in advance. The maximum amount of toner contained in toner storage unit 8 (which will be hereinafter referred to as a "maximum capacity") can be calculated from tire maximum loadable volume of toner storage unit 8. A prescribed amount (the maximum capacity) of toner can be contained in toner storage unit 8. Stirring unit 2, cam unit 3, detector 7, and supply unit 6 are disposed inside toner storage unit 8.

Stirring unit 2 is configured to supply the toner discharged from toner container 5 toward supply unit 6. Stirring unit 2 is configured to stir the stored toner to prevent aggregation of the toner. Thereby, stirring unit 2 ensures the stabilized toner storage state.

Supply unit 6 is located below toner storage unit 8. Supply unit 6 includes a conveyance screw 6*a* and a conveyance tube 6*b*. Conveyance tube 6*b* covers conveyance screw 6*a*. In response to the request from developing device 14 to resupply toner, conveyance screw 6*a* supplies the toner stored in toner storage unit 8 to developing device 14.

Cam unit 3 operates cooperatively with stirring unit 2. Cam unit 3 is attached to the shaft configured to rotate. On the outer circumference of cam unit 3, a curved surface corresponding to the rotation angle of the shaft is formed.

Detector 7 includes a detection member 7*a* and a detection sensor 7*b*. Detection member 7*a* is configured to be movable along a circular arc around its axis. Detection member 7*a* is disposed in loner storage unit 8 so as to be located above the liquid level of the toner.

When the amount of toner stored in toner storage unit 8 is equal to the maximum capacity, detection member 7*a* is always located above cam unit 3 that is rotating. Accordingly, even when cam unit 3 rotates, detection member 7*a* and cam unit 3 do not come into contact with each other. When detection member 7*a* and cam unit 3 do not come into contact with each other, detection sensor 7*b* detects that the amount of toner stored in toner storage unit 8 is equal to the maximum capacity.

When the amount of toner stored in toner storage unit 8 is below the maximum capacity, detection member 7*a* comes into contact with cam unit 3 that is rotating. This causes detection member 7*a* to swing up and down. By detecting that detection member 7*a* swings up and down, detection sensor 7*b* can detect the amount of toner stored in toner storage unit 8. The amount of toner stored in toner storage unit 8 is less when detection member 7*a* more widely swings up and down than when detection member 7*a* less widely swings up and down.

(Toner Container 5)

Figure 4:
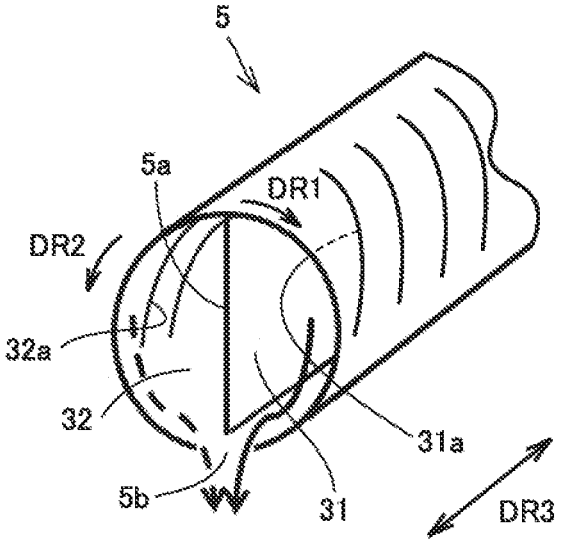
FIG. 4 is a schematic perspective view of a toner container in the first embodiment.

FIG. 4 is a schematic perspective view of toner container 5 in the first embodiment. Toner container 5 is fabricated by blow molding. Toner container 5 contains the toner to be supplied to developing device 14. Toner container 5 has a cylindrical shape. Toner container 5 is provided with a partition portion 5*a* and a discharge port 5*b*. Discharge port 5*b* in the first embodiment is provided at the end of toner container 5.

Partition portion 5*a* extends in an axis direction DR3 of toner container 5. Partition portion 5*a* is provided inside toner container 5. Inside toner container 5, a first container portion 31 and a second container portion 32 are provided. Partition portion 5*a* divides the inside space of toner container 5 into first container portion 31 and second container portion 32. First container portion 31 and second container portion 32 are almost equal in volume. A prescribed amount of toner is contained in each of first container portion 31 and second container portion 32.

Toner container 5 has an inner wall provided with protrusions and recesses in a spiral shape. First container portion 31 has an inner wall provided with a spiral-shaped first spiral portion 31*a* formed of protrusions. Second container portion 32 has an inner wall provided with a spiral-shaped second spiral portion 32*a* formed of protrusions. Second spiral portion 32*a* is opposite in winding direction to first spiral portion 31*a*.

Toner container 5 is rotated by a drive unit (not shown). The DR1 direction in FIG. 4 corresponds to the normal rotation direction of toner container 5. The normal rotation direction corresponds to the direction in which toner container 5 rotates in the clockwise direction when seen from the end of toner container 5 on the discharge port 5*b* side. The DR2 direction in FIG. 4 corresponds to the reverse rotation direction of toner container 5. The reverse rotation direction corresponds to the direction in which toner container 5 rotates in the anticlockwise direction when seen from the end of toner container 5 on the discharge port 5*b* side.

When toner container 5 rotates in normal rotation direction DR1, first spiral portion 31*a* conveys the toner contained in first container portion 31 in the direction approaching discharge port 5*b*. Thereby, the toner contained in first container portion 31 is discharged through discharge port 5*b*.

On the other hand, when toner container 5 rotates in normal rotation direction DR1, second spiral portion 32*a* conveys the toner contained in second container portion 32 in the direction away from discharge port 5*b*. This is because second spiral portion 32*a* is opposite in winding direction to first spiral portion 31*a*. When toner container 5 rotates in normal rotation direction DR1, the toner contained in second container portion 32 is not discharged through discharge port 5*b*.

When the toner in first container portion 31 is completely discharged and then the toner is resupplied in response to the request from developing device 14, toner container 5 rotates in a reverse rotation direction DR2. As toner container 5 rotates in reverse rotation direction DR2, second spiral portion 32*a* conveys the toner contained in second container portion 32 in the direction approaching discharge port 5*b*. Thereby, the toner contained in second container portion 32 is discharged through discharge port 5*b*.

Since toner container 5 in the embodiment is configured to convey toner by means of first spiral portion 31*a* and second spiral portion 32*a*, the force for conveying toner the force for moving toner) is relatively small. Accordingly, the toner contained in second container portion 32 can be prevented from being solidified (packing) due to pressure from the end of toner container 5 on the opposite side of discharge port 5*b*. Furthermore, the above-described configuration can eliminate the need to provide a mechanism for conveying the toner contained in toner container 5, so that the manufacturing cost can be reduced.

(Determiner 33)

Figure 5:
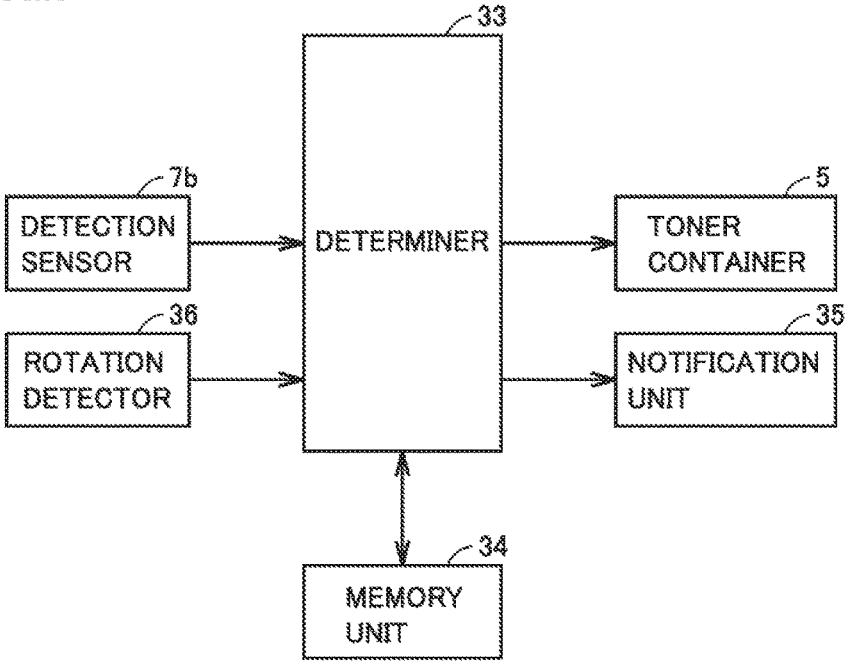
FIG. 5 is a block diagram showing the configuration of the toner supply device.

FIG. 5 is a block diagram showing the configuration of toner supply device 1. Toner supply device 1 further includes a rotation detector 36, a memory unit 34, a notification unit 35, and a determiner 33. Rotation detector 36 is configured to detect the rotation speed and the rotation time of each of conveyance screw 6*a* and toner container 5. Rotation detector 36 can cumulatively count the rotation speed and the rotation time of each of conveyance screw 6*a* and toner container 5.

Memory unit 34 stores the data about the prescribed amount of toner contained in each of first container portion 31 and second container portion 32. Memory unit 34 stores the data about the amount of toner contained in toner container 5. Memory unit 34 stores the data about the maximum capacity of loner storage unit 8.

Based on the information about the amount of toner detected by detection sensor 7*b*, determiner 33 determines whether to start or stop the operation of discharging the toner from toner container 5. Based on the command from determiner 33, notification unit 35 notifies that the toner near empty stale (the state where the amount of toner contained in toner container 5 is equal to or less than a prescribed amount) occurs or the toner empty state (the state where the amount of available toner contained in toner container 5 is zero) occurs.

(Method of Estimating Amount of Toner Remaining in Toner Container 5)

Toner storage unit 8 is maintained in the state where the amount of toner equal to the maximum capacity is stored. When the toner in developing device 14 is consumed, developing device 14 requests toner supply device 1 to resupply toner in accordance with the amount of consumption. In response to the request from developing device 14 to resupply toner, conveyance screw 6*a* resupplies the toner stored in toner storage unit 8 to developing device 14. Rotation detector 36 cumulatively counts the rotation speed and the rotation time of each of toner container 5 and conveyance screw 6*a*.

By resupplying toner to developing device 14, the amount of toner stored in toner storage twit 8 decreases. Accordingly, the liquid level of the toner stored in toner storage unit 8 lowers, so that detection member 7*a* and cam unit 3 come into contact with each other. When detection member 7*a* and cam unit 3 come into contact with each other, detection sensor 7*b* detects that the amount of toner in toner storage unit 8 has decreased as compared with the maximum capacity.

When detection sensor 7*b* detects that the amount of loner in toner storage unit 8 has decreased, determiner 33 causes toner container 5 to normally rotate in normal rotation direction DR1. Determiner 33 causes the toner to be discharged from first container portion 31 until the amount of toner in toner storage unit 8 reaches the maximum capacity (until detection sensor 7*b* detects that the amount of toner stored in toner storage unit 8 reaches the maximum capacity). When detection sensor 7*b* detects that the amount of toner stored in toner storage unit 8 reaches the maximum capacity, determiner 33 stops rotation of toner container 5. In this way, toner storage unit 8 is maintained in the state where the amount of toner equal to the maximum capacity is stored.

In the case where detection sensor 7*b* detects no increase in the amount of toner in toner storage unit 8 even when toner container 5 is driven to normally rotate, determiner 33 determines that the amount of available toner contained in first container portion 31 reaches zero.

When determiner 33 determines that the amount of available toner contained in first container portion 31 reaches zero, determiner 33 causes toner container 5 to rotate in reverse rotation direction DR2. Thereby, toner is resupplied from second container portion 32 to toner storage unit 8. Also when toner is discharged from second container portion 32, through the flow similar to the above, toner storage unit 8 is maintained in the state where the amount of toner equal to the maximum capacity is stored therein.

As described above, when the toner stored in toner storage unit 8 is supplied to developing device 14, toner is resupplied from toner container 5 to toner storage unit 8. In this way, during repetitions of supply of loner to developing device 14 and resupply of toner from toner container 5, detection sensor 7*b* detects the amount of toner stored in toner storage unit 8 and also the amount of toner to be supplied to developing device 14.

As described above, first container portion 31 contains a known prescribed amount of loner. As first container portion 31 is provided in toner container 5, a prescribed amount of contained loner can be discharged from toner container 5.

Rotation detector 36 detects the driving amount applied during a time period from when a prescribed amount of toner is discharged from toner container 5 (first container portion 31) until when detection sensor 7*b* detects that the toner equal in amount to the above-mentioned prescribed amount of toner has been supplied to developing device 14. The driving amount corresponds to the driving amount for the mechanism used when toner is discharged from toner container 5, and corresponds to the driving amount for toner container 5 in toner supply device 1 in the first embodiment. The driving amount for toner container 5 corresponds to the cumulative rotation speed or the cumulative rotation time of toner container 5.

Based on the data of the above-described driving amount for toner container 5 that is detected by rotation detector 36 and the data stored in memory unit 34 about the prescribed amount of toner contained in first container portion 31, determiner 33 calculates the driving amount for toner container 5 relative to the amount of toner consumed by developing device 14. Determiner 33 calculates the driving amount for toner container 5 relative to the amount of toner consumed when an image is formed on a recording medium.

Based on the data of the above-described calculated driving amount and the data stored in memory unit 34 about the prescribed amount of toner contained in second container portion 32, determiner 33 calculates the driving amount for toner container 5 applied until the toner contained in second container portion 32 (remaining in toner container 5) is completely consumed. Thereby, the rotation speed or the rotation time required until the amount of available toner contained in second container portion 32 reaches zero can be estimated.

The spiral shapes formed on the inner walls of first container portion 31 and second container portion 32 are different in winding direction from each other, but are approximately identical in spiral pitch, spiral shape, number of spirals and the like to each other. Furthermore, as described above, the force for moving the toner in toner container 5 is relatively small, so that packing is less likely to occur.

Accordingly, when toner container 5 continuously rotates in one direction, there are relatively less changes in the state where the toner is discharged from first container portion 31 and second container portion 32. Thus, the data obtained during the normal rotation drive (the driving amount for conveyance screw 6*a* relative to the amount of toner consumed by developing device 14) can be used also during the reverse rotation drive.

In addition, when the normal rotation drive is switched to the reverse rotation drive, the stabilized toner discharging state can be ensured by adding the drive time period required until the toner accumulated at the end of second container portion 32 on the opposite side of discharge port 5*b* reaches discharge port 5*b*.

As described above, based on the data about resupply of the prescribed amount of toner contained in first container portion 31, the timing at which the toner remaining in toner container 5 (second container portion 32) is completely consumed (the amount of toner remaining in toner container 5) is estimated. Thereby, the amount of toner remaining in toner container 5 can be estimated with sufficient accuracy.

When the amount of toner remaining in toner container 5 becomes equal to or less than the prescribed amount, determiner 33 can cause notification unit 35 to notify that toner container 5 is in the toner near empty state. The above-described configuration may be used to implement a system for automatically delivering a toner container 5 for replacement to a user. In the above-described system, when notification about the toner near empty state is delayed, arrival of the toner container for replacement at the user may be not in time, so that the image forming apparatus may become unable to be used.

On the other hand, when the toner near empty state is notified too early, there are possibilities that the currently used toner container may be replaced with a new toner container even though sufficient toner remains in the currently used toner container, and that the storage space for the toner container may need to be prepared on the user side. Thus, in order to effectively operate the system for automatically delivering a toner container, the amount of toner remaining in the toner container needs to be estimated with sufficient accuracy.

In toner supply device 1 in the first embodiment, the amount of toner remaining in toner container 5 is estimated based on the data obtained when the toner contained in first container portion 31 is actually consumed. Accordingly, the amount of toner remaining in toner container 5 can be estimated with high accuracy.

Furthermore, when the component dimensions of first container portion 31 (toner container 5), the storage conditions of toner container 5, the production conditions of toner, and the use environment of first container portion 31 (the use conditions, the temperature, the humidity, and the like of the image forming apparatus) are approximately the same as those of second container portion 32, the amount of toner remaining in toner container 5 can be estimated with higher accuracy.

Furthermore, after toner container 5 becomes empty, not only the amount of toner remaining in toner container 5 after replacement can be estimated, but also the amount of toner remaining in toner container 5 immediately after replacement (or that is currently used) can be estimated with high accuracy.

By providing first container portion 31 and second container portion 32 in toner container 5, it becomes unnecessary to provide a separate configuration for discharging a prescribed amount of toner from toner container 5. Thereby, toner supply device 1 can be formed in a simple configuration.

Second Embodiment

In toner supply device 1 in the second embodiment, rotation detector 36 detects the driving amount for supply unit 6 (conveyance screw 6*a*), which is applied during the time period from when a prescribed amount of toner is discharged from toner container 5 (first container portion 31) until when detection sensor 7*b* detects that the toner equal in amount to the above-described prescribed amount of toner has been supplied to developing device 14. The driving amount for conveyance screw 6*a* corresponds to the cumulative rotation speed or the cumulative rotation time of conveyance screw 6*a*.

The spiral shape provided on the inner wall of loner container 5 is smaller in pitch than conveyance screw 6*a*. Accordingly, by calculating the driving amount based on conveyance screw 6*a*, the amount of toner remaining in toner container 5 can be estimated with higher accuracy.

Third Embodiment

Figure 6:
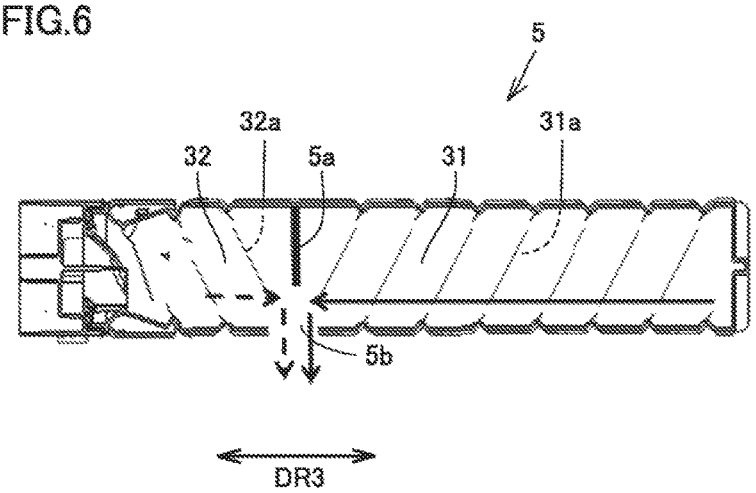
FIG. 6 is a schematic diagram of a toner container in the third embodiment.
Figure 7:
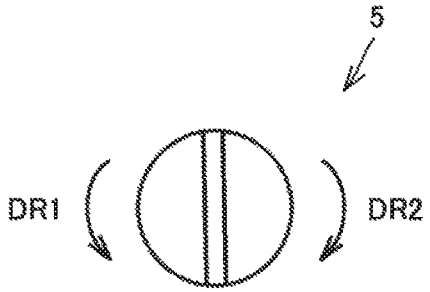
FIG. 7 is a side view of the toner container shown in FIG. 6.

FIG. 6 is a schematic diagram of a toner container 5 in the third embodiment. FIG. 7 is a side view of toner container 5 shown in FIG. 6. In toner container 5 in the third embodiment, a discharge port 5*b* is provided between first container portion 31 and second container portion 32 in an axis direction DR3. First container portion 31 and second container portion 32 are arranged side by side in axis direction DR3 of toner container 5. A partition portion 5*a* is provided between first container portion 31 and second container portion 32. First container portion 31 and second container portion 32 each contains a prescribed amount of toner.

Also in toner container 5 in the third embodiment, based on the data about resupply of a prescribed amount of toner contained in first container portion 31, the timing at which the toner remaining in toner container 5 (second container portion 32) is completely consumed (the amount of toner remaining in toner container 5) is estimated.

Also in toner container 5 in the third embodiment, the effect of accurately estimating the amount of toner remaining in toner container 5 is achieved, as in toner supply device 1 including toner container 5 in the first embodiment.

Fourth Embodiment

When the inside space of toner container 5 is not divided by partition portion 5*a*, a prescribed amount of toner contained therein may not be able to be discharged only by means of toner container 5. However, according to toner container 5 in the fourth embodiment, a prescribed amount of toner can be discharged by using toner storage unit 8. In the following, a method of estimating the amount of toner remaining in toner container 5 in the fourth embodiment will be described.

When the amount of available toner stored in toner storage unit 8 becomes zero, detection sensor 7*b* detects that the amount of available toner is zero. Determiner 33 causes notification unit 35 to notify that the toner empty state occurs, so as to urge replacement of toner container 5. When a new toner container 5 is installed in container accommodating unit 9 in response to the instruction from notification unit 35, toner container 5 is driven to normally rotate, so that toner is discharged from loner container 5 to toner storage unit 8. Thereby, toner is resupplied from toner container 5 to toner storage unit 8.

Until the amount of toner stored in toner storage unit 8 becomes equal to the maximum capacity, determiner 33 causes the toner to be resupplied to toner container 5. Since the maximum capacity of toner storage unit 8 is a known value, a prescribed amount of toner (equal to the maximum capacity) can be discharged from toner container 5 by using toner storage unit 8. Thereby, toner storage unit 8 can store a prescribed amount of toner.

As in toner supply device 1 in each of the first to third embodiments, in response to the request from developing device 14 to resupply toner, conveyance screw 6*a* supplies the toner stored in toner storage unit 8 to developing device 14. In this case, until detection sensor 7*b* again detects that the amount of available toner stored in toner storage unit 8 becomes zero, toner is not discharged from toner container 5 to toner storage unit 8.

Toner is not discharged from toner container 5 to toner storage unit 8 during the time period from when a prescribed amount of toner (equal to the maximum capacity) is discharged from toner container 5 to toner storage unit 8 until when detection sensor 7*b* detects that the toner equal in amount to the maximum capacity has been supplied to developing device 14.

Rotation detector 36 detects the driving amount for conveyance screw 6*a*, which is applied during the time period from when a prescribed amount of toner (equal to the maximum capacity) is discharged from toner container 5 to toner storage unit 8 until when detection sensor 7*b* again detects that the amount of available toner stored in toner storage unit 8 becomes zero.

Based on the data about the driving amount detected by rotation detector 36 and the data stored in memory unit 34 about the maximum capacity of toner storage unit 8, determiner 33 calculates the driving amount for conveyance screw 6*a* relative to the amount of toner consumed by developing device 14.

Based on the calculated data as described above, the data stored in memory unit 34 about the prescribed amount of toner contained in toner container 5, and the data about the maximum capacity of toner storage unit 8, determiner 33 calculates the cumulative rotation speed or the cumulative rotation time of conveyance screw 6*a* that are required to consume the toner remaining in toner container 5.

According to toner container 5 in the fourth embodiment, by the configuration in which the amount of toner remaining in toner container 5 is estimated by using toner storage unit 8, the effect of more accurately estimating the amount of toner remaining in toner container 5 is achieved.

Also, the present embodiment employs the configuration in which toner container 5 is rotated as a mechanism for discharging toner from toner container 5 to move the toner contained therein by the spiral shape formed on the inner wall. Alternatively, there may be another mechanism for conveying the toner contained in toner container 5. In this case, rotation detector 36 may be configured to detect the driving amount for this another mechanism as a driving amount.

In the present embodiment, rotation detector 36, memory unit 34, notification unit 35, and determiner 33 are configured to be included in toner supply device 1, but may be included in controller 24.

This toner supply device includes a toner container, a detector, and a determiner. The toner container is configured to contain toner to be supplied to a developing device. The toner container is capable of discharging a prescribed amount of toner contained therein. The detector is configured to detect an amount of toner to be supplied to the developing device. The determiner is configured to estimate a timing at which loner remaining in the toner container is completely consumed, based on a driving amount applied for discharging toner from the toner container during a time period from when the prescribed amount of toner is discharged from the toner container until when the detector detects an amount of toner equal to the prescribed amount of toner.

According to the toner supply device, the amount of toner remaining in the toner container can be estimated with accuracy.

In the toner supply device, the driving amount is a cumulative rotation speed or a cumulative rotation time of the toner container. Thereby, the amount of toner remaining in the toner container can be estimated with accuracy.

The toner supply device includes a toner container, a supply unit, a detector, and a determiner. The toner container is configured to contain toner to be supplied to the developing device. The toner container is capable of discharging a prescribed amount of toner contained therein. The supply unit is configured to supply toner to the developing device. The detector is configured to detect an amount of toner to be supplied to the developing device. The determiner is configured to estimate a timing at which toner remaining in the toner container is completely consumed, based on a driving amount applied for discharging toner from the toner container during a time period from when the prescribed amount of toner is discharged from the loner container until when the detector detects an amount of toner equal to the prescribed amount of toner.

According to the toner supply device, the amount of toner remaining in the toner container can be estimated with accuracy.

In the toner supply device, the supply unit serves as a conveyance screw provided downstream from the toner container. The driving amount is a cumulative rotation speed or a cumulative rotation time of the conveyance screw. Thereby, the amount of toner remaining in the toner container can be estimated with accuracy.

In the toner supply device, the toner container includes a first container portion in which the prescribed amount of toner is contained. The determiner is configured to estimate a timing at which toner remaining in the toner container is completely consumed, based on the driving amount applied during a time period from when the prescribed amount of toner is discharged from the first container portion until when the detector detects an amount of toner equal to the prescribed amount of toner. This eliminates the need to separately provide another configuration for discharging the prescribed amount of toner from the toner container. Accordingly, the toner supply device can be formed in a simple configuration.

In the toner supply device, the toner container further includes a second container portion. The toner container is configured to rotate in a normal rotation direction to discharge toner contained in the first container portion. The toner container is configured to rotate in a reverse rotation direction to discharge toner contained in the second container portion. The determiner is configured to estimate a timing at which toner contained in the second container portion is completely consumed, based on the driving amount applied during a time period from when the prescribed amount of toner is discharged from the first container portion until when the detector detects an amount of toner equal to the prescribed amount of toner. This eliminates the need to separately provide another configuration for discharging the prescribed amount of toner from the toner container. Accordingly, the toner supply device can be formed in a simple configuration.

In the toner supply device, the first container portion and the second container portion are disposed side by side in an axis direction of the toner container formed in a cylindrical shape. This eliminates the need to separately provide another configuration for discharging the prescribed amount of toner from the toner container. Accordingly, the toner supply device can be formed in a simple configuration.

In the toner supply device, the toner container has an inner wall formed in a spiral shape. Thereby, the manufacturing cost can be reduced.

The toner supply device further includes a loner storage unit in which loner discharged from the loner container is stored. The toner storage unit is capable of storing the prescribed amount of toner. Thereby, the amount of toner remaining in the toner container can be estimated with accuracy.

In the toner supply device, the toner container is configured to refrain from discharging toner to the toner storage unit during a time period from when the prescribed amount of toner is discharged from the toner container to the toner storage unit until when the detector detects an amount of toner equal to the prescribed amount of toner. Thereby, the amount of toner remaining in the toner container can be estimated with accuracy.

The image forming apparatus includes: the toner supply device according to any one of the above-described aspects, and a container accommodating unit in which the toner container is accommodated. Thereby, the image forming apparatus capable of accurately estimating the amount of toner remaining in the toner container can be implemented.

According to the present disclosure, it becomes possible to implement a toner supply device and an image forming apparatus, for which the accuracy of estimating the amount of toner remaining in a toner container can be improved.

Although embodiments of the present invention have been described and illustrated in detail, the disclosed embodiments are made for purposes of illustration and example only and not limitation. The scope of the present invention should be interpreted by terms of the appended claims.

What is claimed is:

1. A toner supply device comprising:

a toner container in which toner to be supplied to a developing device is contained, the toner container being capable of discharging a prescribed amount of toner contained therein;

a detector configured to detect an amount of toner to be supplied to the developing device; and a determiner configured to estimate a timing at which toner remaining in the toner container is completely consumed, based on a driving amount applied for discharging toner from the toner container during a time period from when the prescribed amount of toner is discharged from the toner container until when the detector detects an amount of toner equal to the prescribed amount of toner.

2. The toner supply device according to claim 1, wherein the driving amount is a cumulative rotation speed or a cumulative rotation time of the toner container.

3. The toner supply device according to claim 1, wherein the toner container includes a first container portion in which the prescribed amount of toner is contained, and the determiner is configured to estimate a timing at which toner remaining in the toner container is completely consumed, based on the driving amount applied during a time period from when the prescribed amount of toner is discharged from the first container portion until when the detector detects an amount of toner equal to the prescribed amount of toner.

4. The toner supply device according to claim 3, wherein the toner container further includes a second container portion, the toner container is configured to rotate in a normal rotation direction to discharge toner contained in the first container portion, the toner container is configured to rotate in a reverse rotation direction to discharge toner contained in the second container portion, and the determiner is configured to estimate a timing at which toner contained in the second container portion is completely consumed, based on the driving amount applied during a time period from when the prescribed amount of toner is discharged from the first container portion until when the detector detects an amount of toner equal to the prescribed amount of toner.

5. The toner supply device according to claim 4, wherein the first container portion and the second container portion are disposed side by side in an axis direction of the toner container formed in a cylindrical shape.

6. The toner supply device according to claim 1, wherein the toner container has an inner wall formed in a spiral shape.

7. The toner supply device according to claim 1, further comprising a toner storage unit in which loner discharged from the toner container is stored, wherein the toner storage unit is capable of storing the prescribed amount of loner.

8. The toner supply device according to claim 7, wherein the toner container is configured to refrain from discharging toner to the toner storage unit during a time period from when the prescribed amount of toner is discharged from the toner container to the toner storage unit until when the detector detects an amount of toner equal to the prescribed amount of toner.

9. An image forming apparatus comprising:

the toner supply device according to claim 1; and a container accommodating unit in which the toner container is accommodated.

10. A toner supply device comprising:

a toner container in which toner to be supplied to a developing device is contained, the toner container being capable of discharging a prescribed amount of toner contained therein;

a supply unit configured to supply toner to the developing device;

a detector configured to detect an amount of toner to be supplied to the developing device; and a determiner configured to estimate a timing at which toner remaining in the toner container is completely consumed, based on a driving amount for the supply unit applied during a time period from when the prescribed amount of toner is discharged from the toner container until when the detector detects an amount of toner equal to the prescribed amount of toner.

11. The toner supply device according to claim 10, wherein the supply unit is a conveyance screw provided downstream from the toner container, and the driving amount is a cumulative rotation speed or a cumulative rotation time of the conveyance screw.

12. The toner supply device according to claim 10, wherein the toner container includes a first container portion in which the prescribed amount of toner is contained, and the determiner is configured to estimate a timing at which toner remaining in the toner container is completely consumed, based on the driving amount applied during a time period from when the prescribed amount of toner is discharged from the first container portion until when the detector detects an amount of toner equal to the prescribed amount of toner.

13. The toner supply device according to claim 12, wherein the toner container further includes a second container portion, the toner container is configured to rotate in a normal rotation direction to discharge toner contained in the first container portion, the toner container is configured to rotate in a reverse rotation direction to discharge toner contained in the second container portion, and the determiner is configured to estimate a timing at which loner contained in the second container portion is completely consumed, based on the driving amount applied during a time period from when the prescribed amount of loner is discharged from the first container portion until when the detector detects an amount of toner equal to the prescribed amount of toner.

14. The toner supply device according to claim 13, wherein the first container portion and the second container portion are disposed side by side in an axis direction of the toner container formed in a cylindrical shape.

15. The toner supply device according to claim 10, wherein the toner container has an inner wall formed in a spiral shape.

16. The toner supply device according to claim 10, further comprising a toner storage unit in which toner discharged from the toner container is stored, wherein the toner storage unit is capable of storing the prescribed amount of toner.

17. The toner supply device according to claim 16, wherein the toner container is configured to refrain from discharging toner to the toner storage unit during a time period from when the prescribed amount of toner is discharged from the toner container to the toner storage unit until when the detector detects an amount of toner equal to the prescribed amount of toner.

18. An image forming apparatus comprising:

the toner supply device according to claim 10; and a container accommodating unit in which the toner container is accommodated.

* * * * *